US009598228B2

(12) United States Patent
Magdovitz et al.

(10) Patent No.: US 9,598,228 B2
(45) Date of Patent: Mar. 21, 2017

(54) SINGLE-SHEET TUBULAR FOOD CARRIER

(71) Applicant: Brothers Donuts, LLC, Boulder, CO (US)

(72) Inventors: Mitchell P. Magdovitz, Boulder, CO (US); Brett N. Magdovitz, Boulder, CO (US)

(73) Assignee: Brothers Donuts LLC, Boulder, CO (US)

( * ) Notice: Subject to any disclaimer, the term of this patent is extended or adjusted under 35 U.S.C. 154(b) by 0 days.

(21) Appl. No.: 14/694,116

(22) Filed: Apr. 23, 2015

(65) Prior Publication Data

US 2015/0360805 A1 Dec. 17, 2015

Related U.S. Application Data

(60) Provisional application No. 62/012,066, filed on Jun. 13, 2014.

(51) Int. Cl.
*B65D 3/04* (2006.01)
*B65D 3/20* (2006.01)
(Continued)

(52) U.S. Cl.
CPC ..... *B65D 85/36* (2013.01); *B65D 3/04* (2013.01); *B65D 5/0209* (2013.01); *B65D 5/46056* (2013.01); *B65D 5/46096* (2013.01)

(58) Field of Classification Search
CPC ..... B65D 3/04; B65D 3/20; B65D 5/0209; B65D 25/2894; B65D 85/36; B65D 5/46128; B65D 5/46144; Y10S 229/931
(Continued)

(56) References Cited

U.S. PATENT DOCUMENTS 1,288,132 A * 12/1918 Nagle ..... B65D 5/4266 15/41.1
1,787,736 A * 1/1931 Schrier ..... B65D 5/106 229/110
(Continued)

FOREIGN PATENT DOCUMENTS

FR 828286 A * 2/1938 ..... B65D 5/46144
FR 1267551 A * 6/1961 ..... B65D 5/46144

*Primary Examiner* — Gary Elkins
(74) *Attorney, Agent, or Firm* — University of Colorado Entrepreneurial Law Clinic

(57) ABSTRACT

A carrier, such as a food carrier, may include a single sheet of material having a base section, a first end flap connected to the base section at a first end, the first end flap including first and second slots, a second end flap connected to the base section at a second end, the second end flap including third and fourth slots, a first lower section connected to the base section along a first line and including first and second tabs, a second lower section connected to the base section along a second line and including third and fourth tabs, a first upper section connected to the first lower section along a third line, a second upper section connected to the second lower section along a fourth line, wherein the single sheet of material is configured for arrangement in a flat configuration in which the single sheet of material is a substantially flat layer, and an assembled configuration in which the first and second end flaps are substantially perpendicular to the base section, the first tab engages the first slot, the second tab engages the third slot, the third tab engages the second slot, and the fourth tab engages the fourth slot, and the base section, first and second lower sections, and first and second upper sections together form a substantially tubular cross-sectional shape.

14 Claims, 17 Drawing Sheets

(51) Int. Cl.
*B65D 5/46* (2006.01)
*B65D 85/36* (2006.01)
*B65D 5/02* (2006.01)
*B65D 5/478* (2006.01)

(58) Field of Classification Search
USPC .... 229/4.5, 5.5, 5.8, 93, 109, 110, 902, 906, 229/195–197, 117.14
See application file for complete search history.

(56) References Cited

U.S. PATENT DOCUMENTS 2,075,465 A * 3/1937 Powell ..... B65D 3/10 229/122.29
2,123,147 A * 7/1938 Snyder ..... B65D 5/10 229/110
2,156,999 A * 5/1939 McNeil ..... B65D 5/02 229/109
2,659,525 A * 11/1953 Wikstrom ..... B65D 85/67 225/49
3,166,235 A 1/1965 Schroeder
3,610,514 A * 10/1971 Samsing ..... B65D 5/029 229/108
3,738,564 A * 6/1973 Persson ..... B65D 5/16 229/110
4,033,241 A 7/1977 Roda
4,399,939 A * 8/1983 Tunick ..... B65D 5/46128 206/521.1
4,991,734 A 2/1991 Nilsson
5,011,070 A * 4/1991 Plunkett ..... B65D 5/4204 229/104
5,425,498 A 6/1995 Hallam
5,794,842 A 8/1998 Hallam
5,901,902 A 5/1999 Grabher
5,924,560 A 7/1999 Swart
6,003,759 A * 12/1999 Kenner ..... B65D 5/0209 229/104
6,053,400 A 4/2000 Rea
6,976,618 B2 12/2005 Hallam
7,721,942 B2 * 5/2010 Polloni ..... B65D 85/1072 206/271
9,016,475 B2 * 4/2015 Chen ..... B65D 81/022 206/485
2003/0226881 A1 12/2003 Liou
2009/0261152 A1 10/2009 Abbott
2014/0242230 A1 * 8/2014 Iwegbu ..... A47G 21/001 426/389

* cited by examiner

100

100

100

200

200

200

200

SINGLE-SHEET TUBULAR FOOD CARRIER

CROSS-REFERENCE TO RELATED APPLICATIONS

This application claims the benefit of U.S. Provisional Patent Application Ser. No. 62/012,066, filed on Jun. 13, 2014, the contents of which are hereby incorporated by reference in their entireties for all purposes.

TECHNICAL FIELD

Some embodiments relate generally to carriers for round food items, and specifically to generally cylindrical and/or tubular food carriers made from sheet material.

BACKGROUND

Packaging for round food items is currently available in a number of shapes and dimensions. One example of such packaging is the familiar rectangular donut box, wherein donuts or other similar round food items are packed onto a rectangular plane and covered by a rectangular flap. Current solutions for packaging round food items can be unwieldy, having a shape or dimensions that make it difficult for a person to quickly move the container without disturbing the food items inside. Such packaging can reduce the number of packages that a person may confidently transport at one time, thereby reducing the number of food items that can be transported. In addition, the rectangular cross-section of many current solutions can be space-inefficient for packing round food items, increasing materials costs and further reducing the number of food items that may be carried at a time.

Other current solutions for carrying round food items may have other drawbacks. Smaller round food items, such as "donut holes" (i.e. donut balls), may be packaged in cylindrical or tapered containers having heights nearly as great as, or greater than, their lengths or widths. In addition to being difficult to carry because of their height and lack of handle, these packages make it difficult for consumers to view all of the food items when the package is opened. Few of these types of packages are constructed with a "serving configuration" in mind; in other words, little thought is given to how the shape and dimensions of the packaging may be optimized not only for carrying the food items but for displaying and serving them as well. Current packaging solutions are not well-suited to the round shape of the food items they are meant to carry.

Current packaging solutions may also suffer from excessive materials costs due to the need for several separate items to create a closed container.

SUMMARY

Embodiments relate to a single-sheet cylindrical food carrier. In one embodiment, the food carrier is constructed from a single sheet of paperboard. The single sheet of paperboard may have a first outer panel and a second outer panel. Each of the first outer panel and the second outer panel may have an inner long edge, an outer long edge, a first short edge, and a second short edge. Each of the first outer panel and the second outer panel may also have at least two rectangular sections, which may be separated by creases. Each of the first outer panel and the second outer panel may further have a first tab extending from the first short edge and a second tab extending from the second short edge. The rectangular sections of the first outer panel or the second outer panel may have slots.

According to an embodiment, the single sheet of paperboard may also have a first end cap and a second end cap. Each of the first end cap and the second end cap may have a substantially circular end piece. Each of the first end cap and the second end cap may also have at least two tabs extending from the substantially circular end piece.

In an embodiment, the single sheet of paperboard may further have an inner rectangular panel. The inner rectangular panel may lie between the inner long edge of the first outer panel, the inner long edge of the second outer panel, the first end cap, and the second end cap. In some embodiments, the first outer panel, the second outer panel, the first end cap, and the second end cap may be folded upward from their edges of intersection with the inner rectangular panel and joined to form a closed container.

According to some embodiments, the rectangular sections of the first outer panel and the second outer panel may be perforated. In particular embodiments, the first outer panel and the second outer panel may be separable along the perforations.

In another embodiment, the first outer panel, the second outer panel, the first end cap, and the second end cap may be joined by insertion of at least one tab into at least one slot of at least one outer panel. In other embodiments, the first outer panel, the second outer panel, the first end cap, and the second end cap may be joined by glue or other adhesive.

In another embodiment, the food carrier may have a handle. In a further embodiment, the food carrier may have a length of rope, twine, or other similar material connecting the handle to the single sheet of paperboard. In a still further embodiment, the handle may be connected to at least one end cap.

In another embodiment, at least one end cap may be removable.

In another embodiment, the single sheet of paperboard may have a third outer panel. This third outer panel may serve as a flat top for the food carrier.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

A carrier, such as a food carrier, according to an embodiment may include a single sheet of material having a base section, a first end flap connected to the base section at a first longitudinal end of the base section, the first end flap including a first slot and a second slot, a second end flap connected to the base section at a second longitudinal end of the base section, the second end flap including a third slot and a fourth slot, a first lower section connected to the base section along a first line, the first lower section including a first tab at the first longitudinal end and a second tab at the second longitudinal end, a second lower section connected to the base section along a second line, the second lower section including a third tab at the first longitudinal end and a fourth tab at the second longitudinal end, a first upper section connected to the first lower section along a third line, a second upper section connected to the second lower section along a fourth line, wherein the single sheet of material is configured for arrangement in a flat configuration and an assembled configuration, wherein in the flat configuration the single sheet of material is a substantially flat layer, and wherein in the assembled configuration the first and second end flaps are substantially perpendicular to the base section, the first tab engages the first slot, the second tab engages the third slot, the third tab engages the second slot, and the fourth tab engages the fourth slot, and the base section, first and second lower sections, and first and second upper sections together form a substantially tubular cross-sectional shape.

In some cases, two or more, or all of, the first, second, third, and fourth lines are perforated. In some cases, the single sheet of material further comprises a handle. Such a single-sheet carrier may include two or more (and/or five or more) longitudinal folds formed substantially parallel to, and between, one or more of the following pairs of lines: the first and third lines, and the second and fourth lines. Such longitudinal folds may be equally circumferentially spaced with respect to each other.

According to an embodiment, a method of assembling a single-sheet cylindrical food carrier includes folding a first end flap inwardly with respect to a first longitudinal end of a base section, the first end flap including a first slot and a second slot; folding a second flap inwardly with respect to a second longitudinal end of the base section, the second end flap including a third slot and a fourth slot; folding a first lower section inwardly along a first line shared with the base section, the first lower section including a first tab at a first longitudinal end of the first lower section and a second tab at the second longitudinal end of the first lower section; folding a second lower section inwardly along a second line shared with the base section, the second lower section including a third tab at a first longitudinal end of the second lower section and a fourth tab at a second longitudinal end of the second lower section; folding a first upper section inwardly along a third line shared with the first lower section; folding a second upper section inwardly along a fourth line shared with the second lower section; and coupling the first tab with the first slot, the second tab with the third slot, the third tab with the second slot, and the fourth tab with the fourth slot to form a substantially tubular cross-sectional shape.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
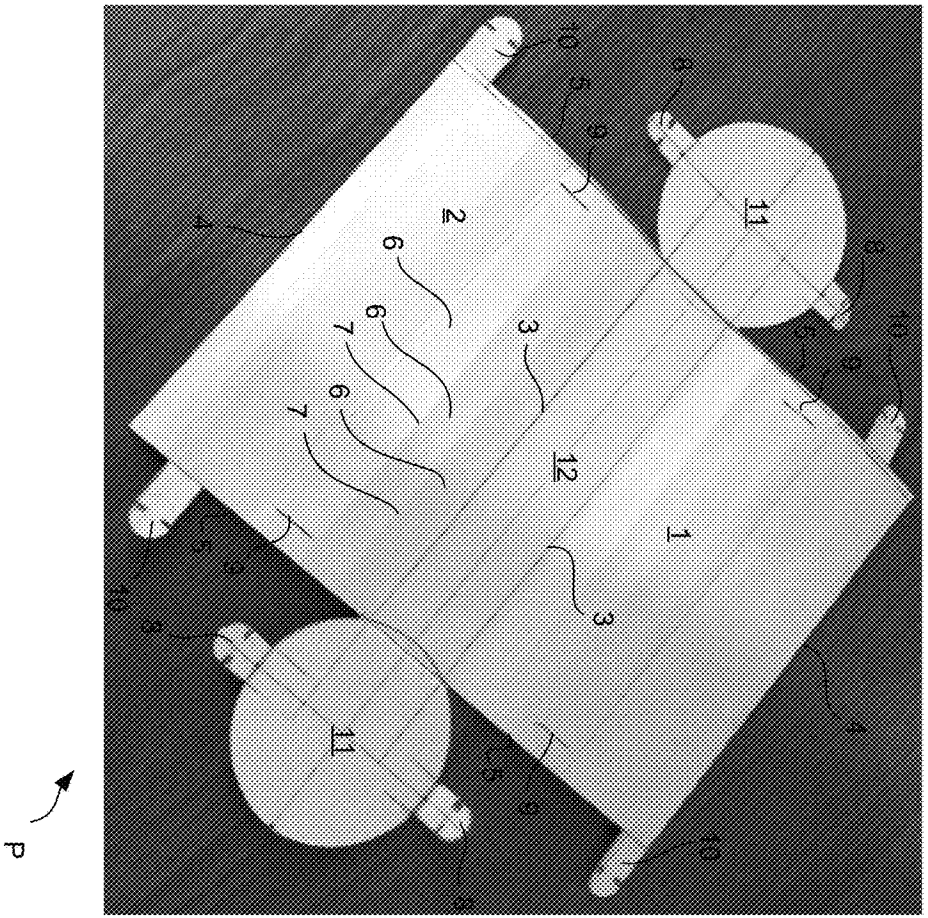
FIG. 1 illustrates a top view of an unfolded single sheet of paperboard.

While the described embodiments are amenable to various modifications and alternative forms, specific embodiments have been shown by way of example in the drawings and are described in detail below. The intention, however, is not to limit the invention to the particular embodiments described. On the contrary, the invention and the description are intended to cover all modifications, equivalents, and alternatives.

DETAILED DESCRIPTION

As illustrated in FIG. 1, a single sheet of paperboard has first outer panel 1 and second outer panel 2. The outer panels 1, 2 have inner long edges 3, outer long edges 4, and short edges 5. The outer panels 1, 2 are made up of rectangular sections 6, separated by creases or folds 7. The end caps 11 are made up of substantially circular end pieces and tabs 8 extending from the substantially circular end pieces 11. The food carrier is constructed by folding the outer panels 1, 2 and the end caps 10 upward from the edges they share with the inner rectangular panel 12. The carrier may then be secured as a closed container by inserting the tabs 8 of the end pieces 11 into one or more slots 9. The tabs may be secured by folding, twisting, interlocking of grooves, and/or with glue or other adhesive, according to some embodiments. The rectangular sections 6 of the outer panels 1, 2 may be folded at an angle with respect to each other along creases 7 to provide a more rigid and/or structurally sound cylindrical shape. As used herein, the term "cylindrical shape" is used in its broadest sense to refer to a generally cylindrical and/or tubular structure, and includes tubular shapes having polygonal cross sections formed by generally flat rectangular sections 6 connected by perforations and/or folds 7.

Figure 2:
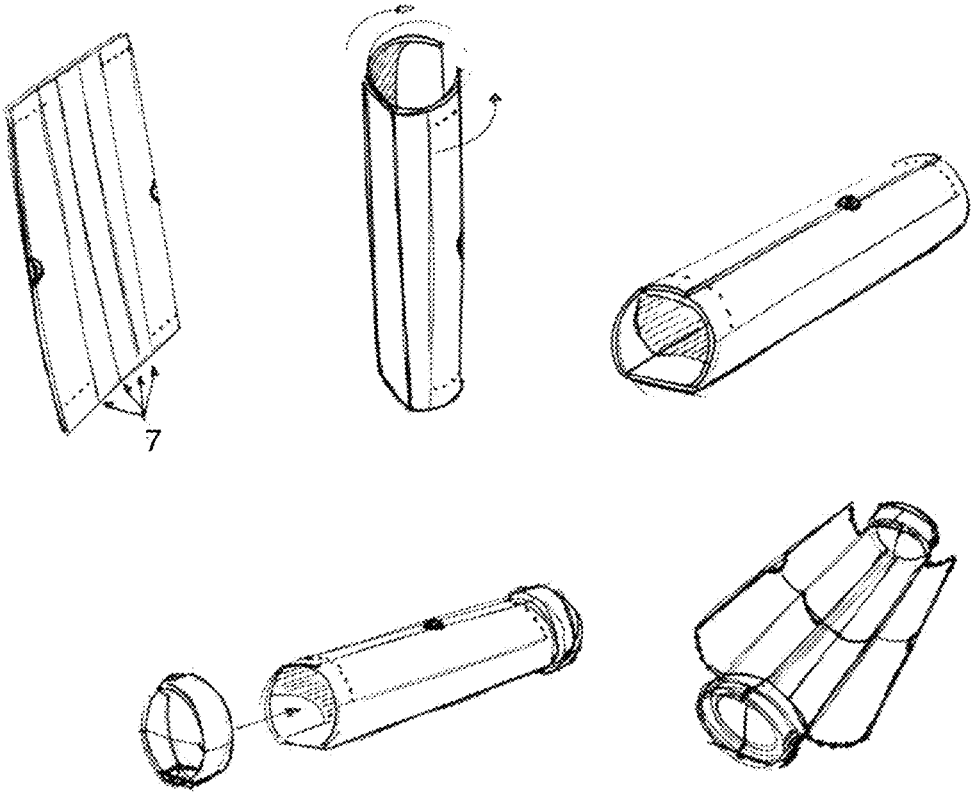
FIG. 2 illustrates an overview of a process for assembling a food carrier from paperboard.

As illustrated in FIG. 2, a fully constructed single-sheet cylindrical food carrier is shown. The outer panels have been joined by means of glue or other adhesive (not shown). Several of the rectangular sections of the outer panels have perforations 7. The perforations allow the food carrier to be neatly opened to a presentation configuration. As also shown in FIG. 2, the outer panels may be separated along the perforations in the rectangular sections. As illustrated, a single sheet of paperboard is folded into a cylindrical food carrier along perforations/creases 7 in the sheet. The sheet is rolled into a cylindrical shape and then secured with glue or other adhesive (not shown).

Figure 3:
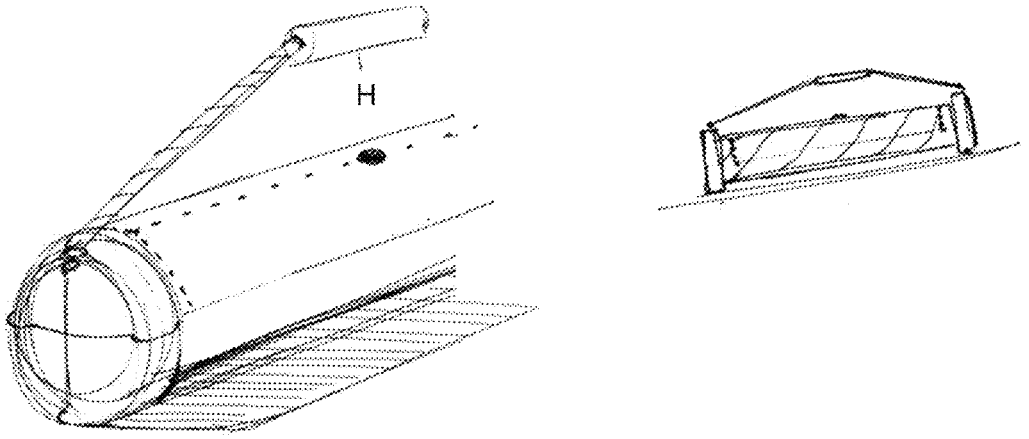
FIG. 3 illustrates an embodiment of a food carrier with a handle made of rope or twine.
Figure 25:
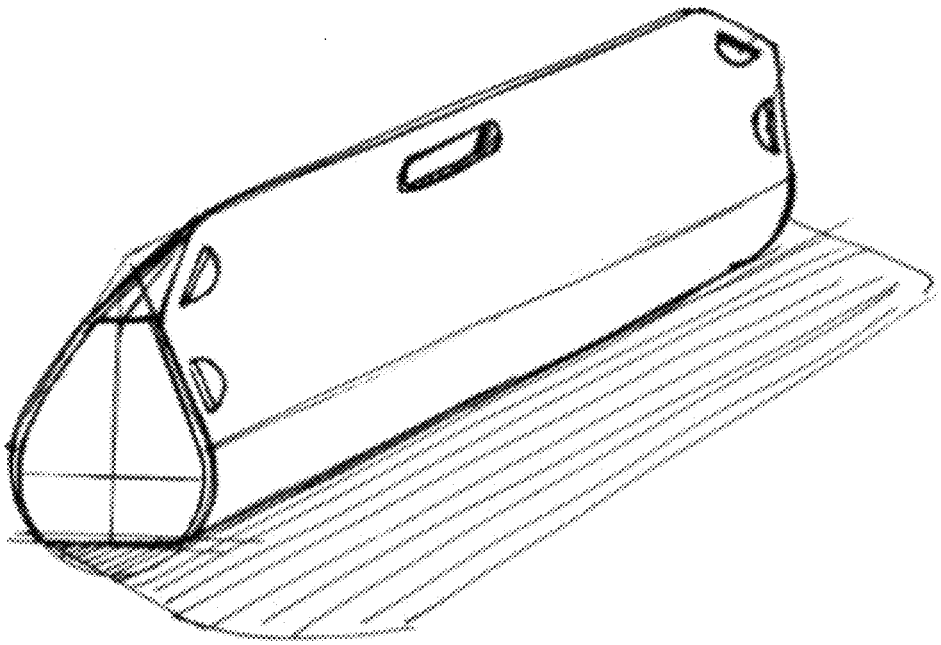
FIG. 25 illustrates an embodiment of a food carrier.
Figure 26:
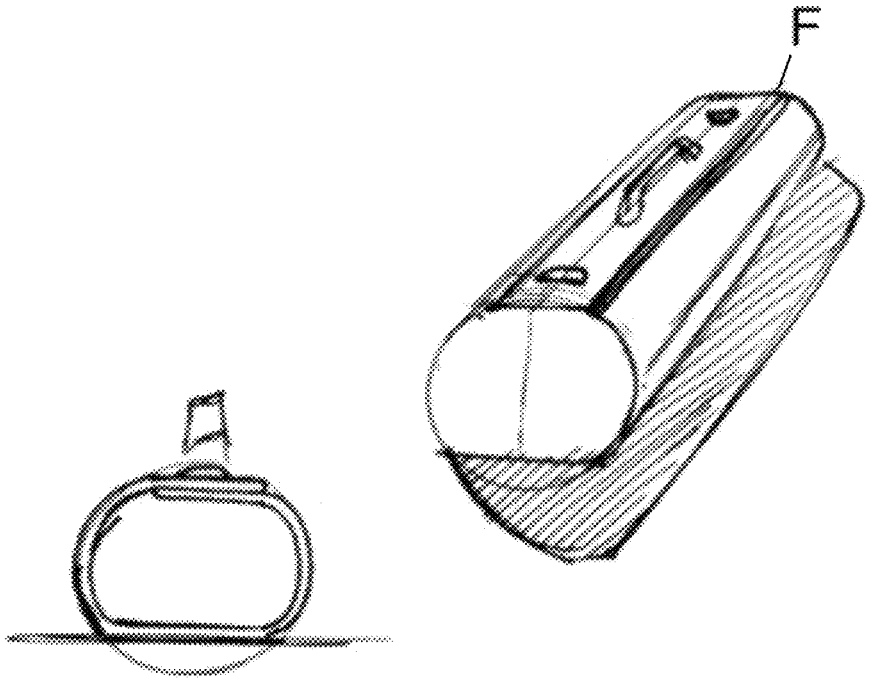
FIG. 26 illustrates an embodiment of a food carrier.

FIG. 3 illustrates a single-sheet cylindrical food carrier that has a handle H. The handle H is attached to both ends of the food carrier by means of a length of rope or twine. FIG. 25 illustrates a single-sheet cylindrical food carrier. In some instances, as illustrated in FIG. 26, the single sheet of paperboard of the single-sheet cylindrical food carrier has a third outer panel F (i.e. a "flat top" panel). When the food carrier is constructed, the third outer panel F serves as a flat top for the food carrier. Multiple food carriers may then be more easily stacked on top of each other.

Figure 4:
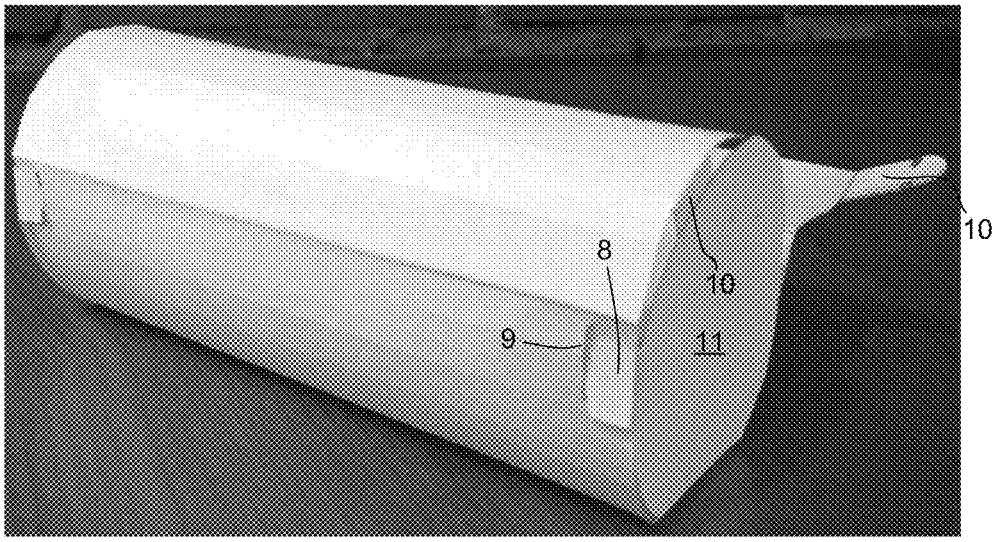
FIG. 4 illustrates a perspective view of a food carrier that is partially formed from the single sheet of paperboard of FIG. 1.
Figure 5:
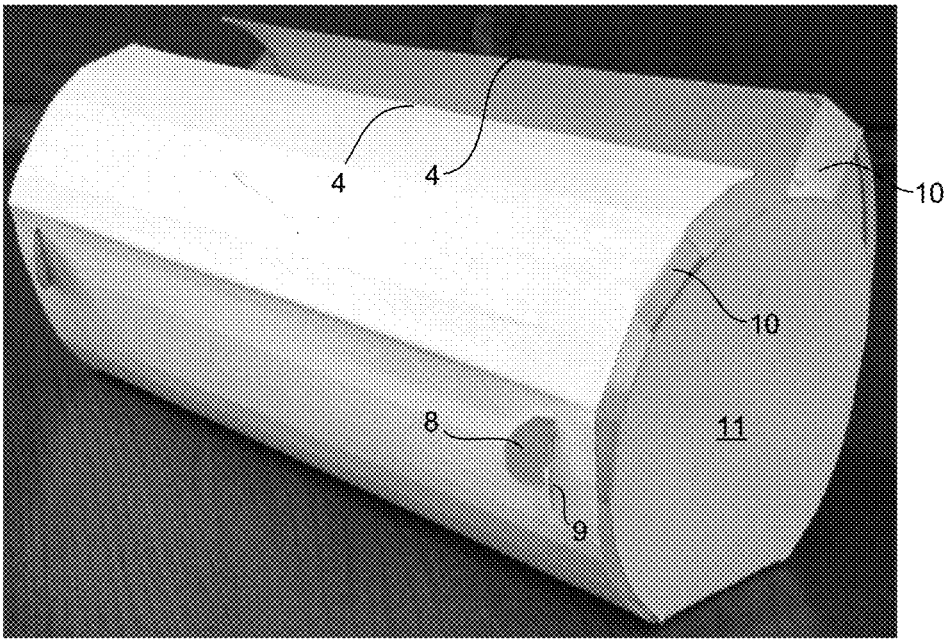
FIG. 5 illustrates a perspective view of a food carrier that is partially formed from the single sheet of paperboard of FIGS. 1 and 4.
Figure 6:
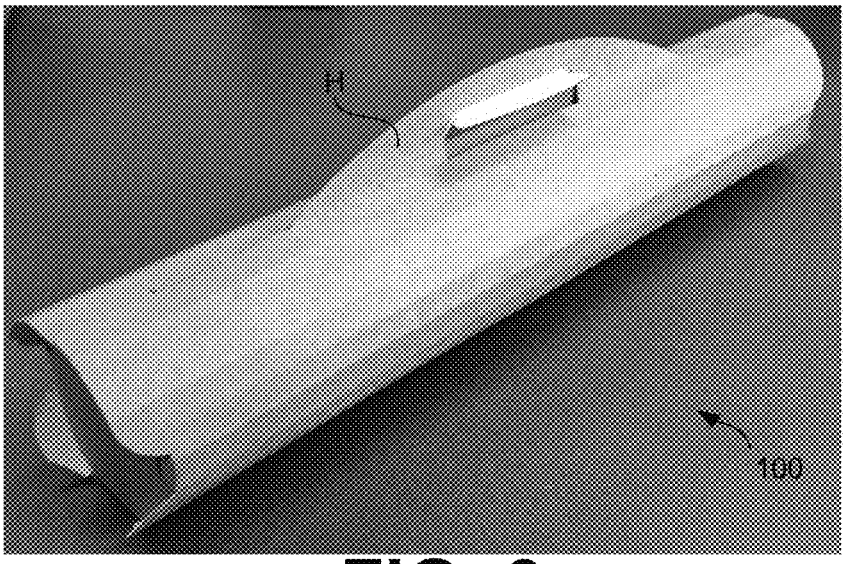
FIG. 6 illustrates a top perspective view of an embodiment of an assembled food carrier.
Figure 7:
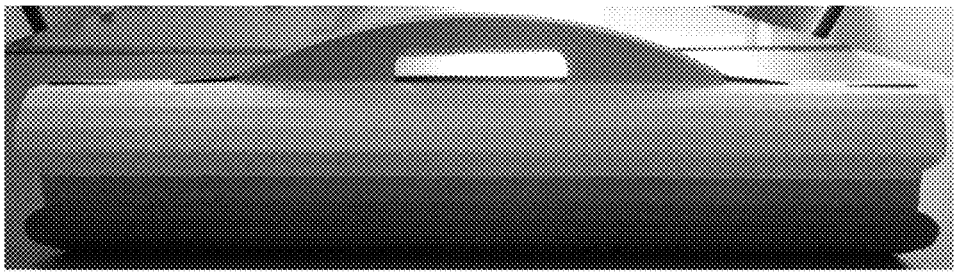
FIG. 7 illustrates a front view of the assembled food carrier of FIG. 6.
Figure 8:
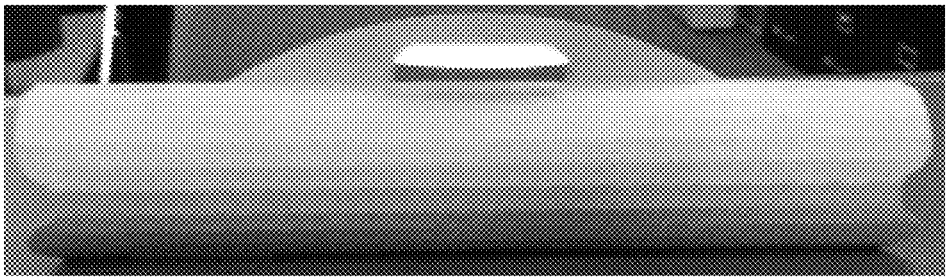
FIG. 8 illustrates a back view of the assembled food carrier of FIGS. 6 and 7.
Figure 9:
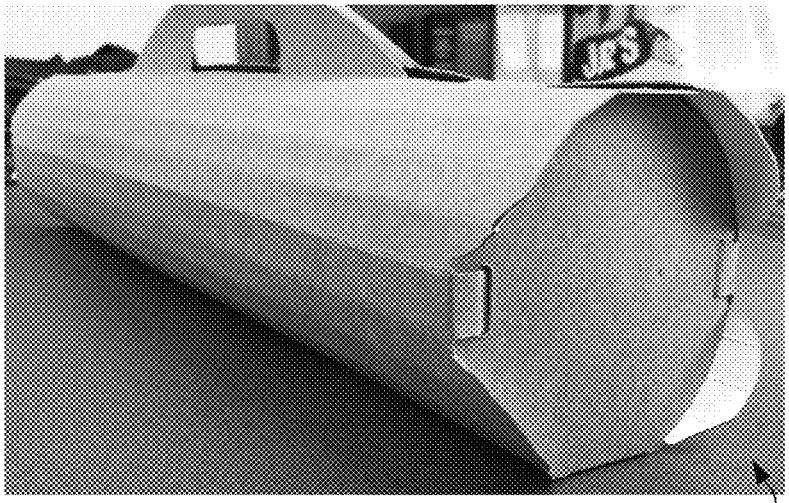
FIG. 9 illustrates a side perspective view of the assembled food carrier of FIGS. 6-8.
Figure 10:
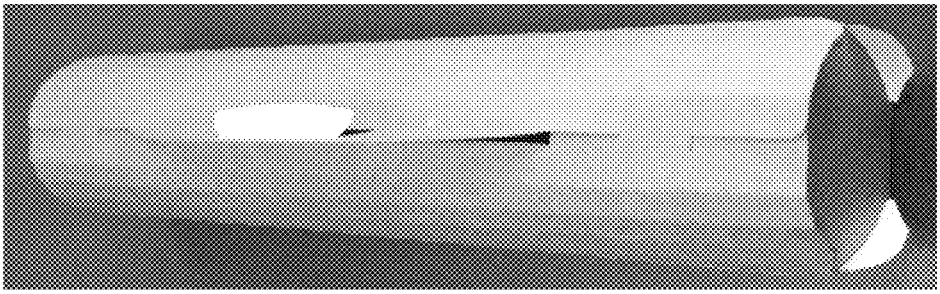
FIG. 10 illustrates a top perspective view of the assembled food carrier of FIGS. 6-9.
Figure 11:
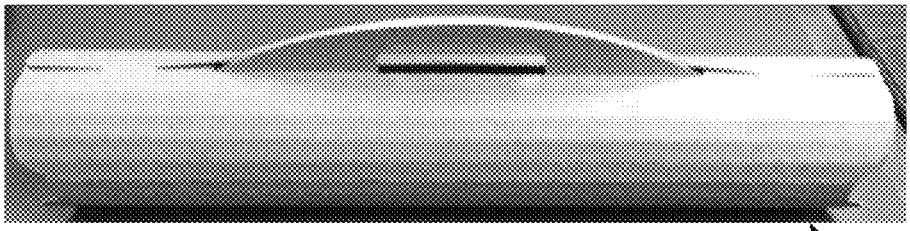
FIG. 11 illustrates a front top perspective view of the assembled food carrier of FIGS. 6-10.

FIG. 4 illustrates the single-sheet cylindrical food carrier that has been partially assembled by folding the single sheet of paperboard P. The single sheet of paperboard P has been folded along creases in the sheet. The sheet is in a substantially cylindrical or tubular shape and has been partially secured by the insertion of tabs 8 into corresponding slots 9. The tabs 8 may be inserted through slots 9 from the outside toward the inside of the container, as shown in FIG. 4; alternatively, the tabs 8 may be inserted through slots 9 from the inside toward the outside of the container, as shown in FIG. 5. The length of side elements 1, 2 may be selected so as to include an overlap of long edges 4 when the paperboard P is in the assembled configuration, in some embodiments. The tabs 10 may be secured to each other to enclose the carrier, or the side elements 1, 2 may be overlapped and the tabs 10 folded under the opposite side element to secure them together, and/or the tabs 10 may be connected to (e.g. with adhesive or by additional slots or other connecting arrangements) the end members 11, according to some embodiments.

Figure 12:
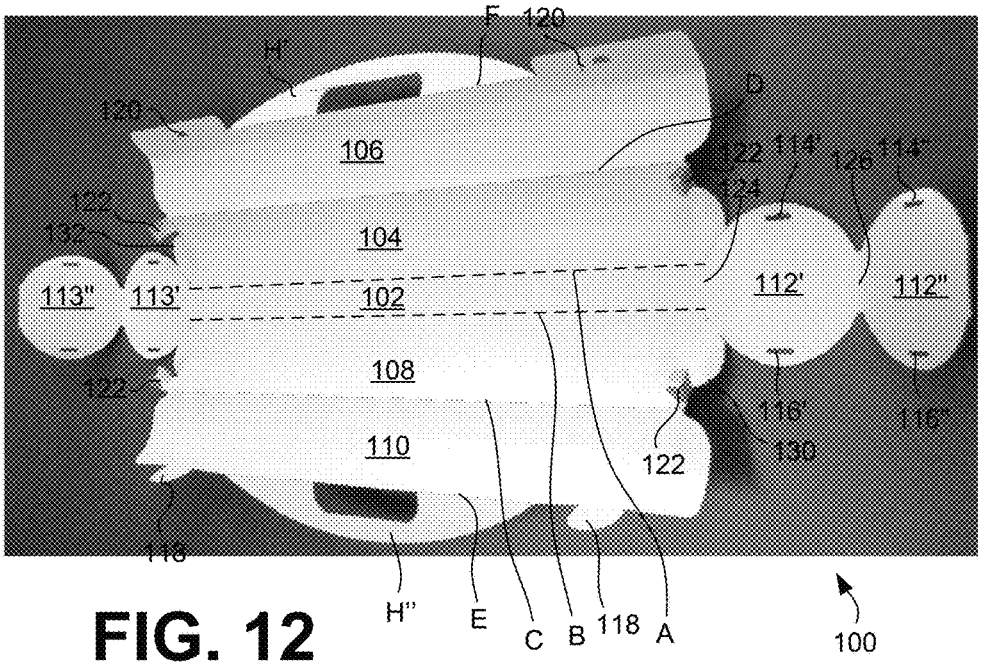
FIG. 12 illustrates a top view of a the food carrier of FIGS. 6-11 in an unfolded or unassembled configuration.
Figure 13:
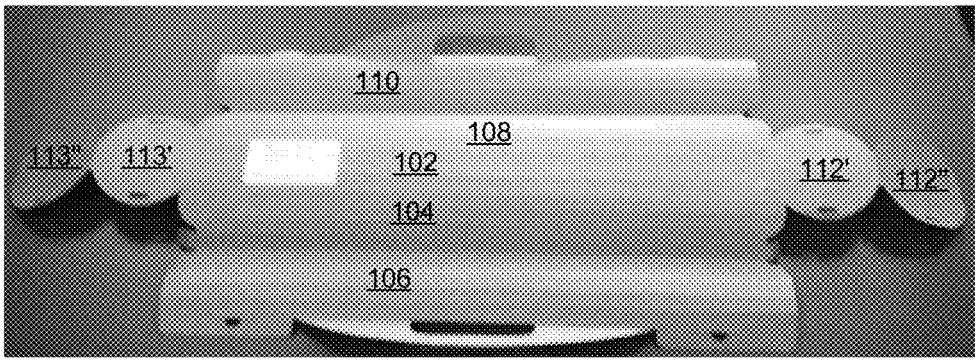
FIG. 13 illustrates a bottom view of the food carrier of FIGS. 6-12 in an unfolded or unassembled configuration.
Figure 14:
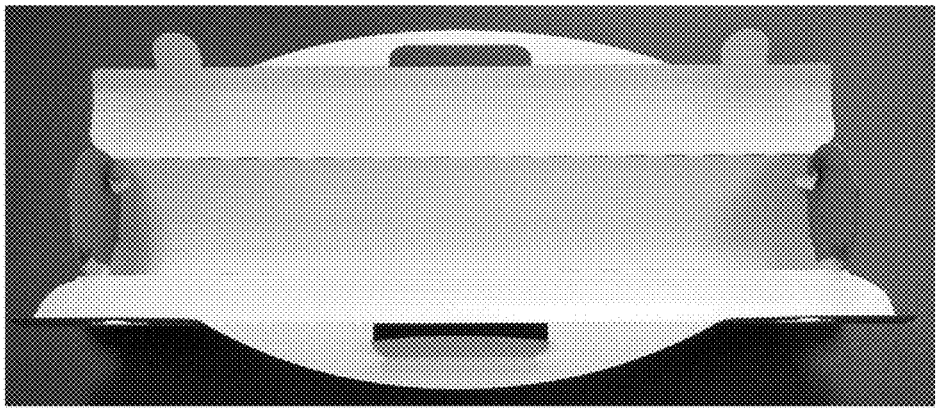
FIG. 14 illustrates a front top view of the food carrier of FIGS. 6-13 in an assembled and open configuration.
Figure 15:
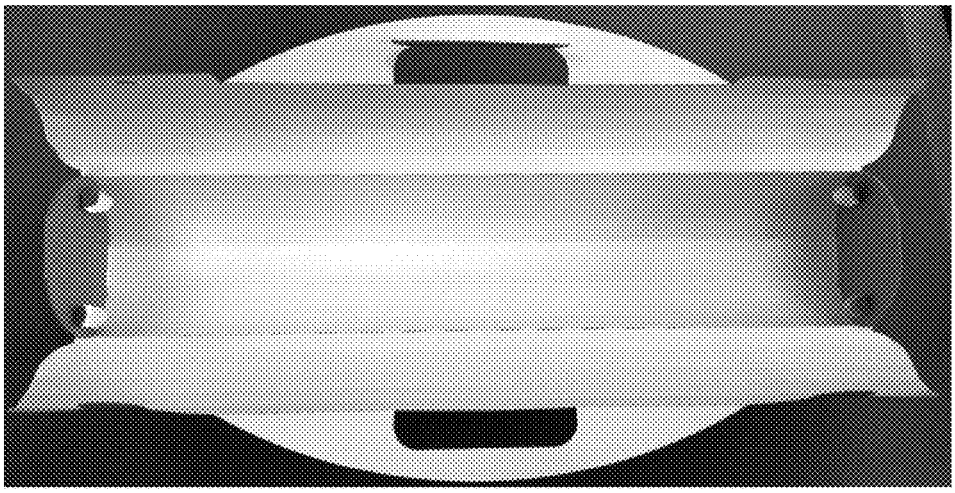
FIG. 15 illustrates a back top view of the food carrier of FIGS. 6-14 in an assembled and open configuration.
Figure 16:
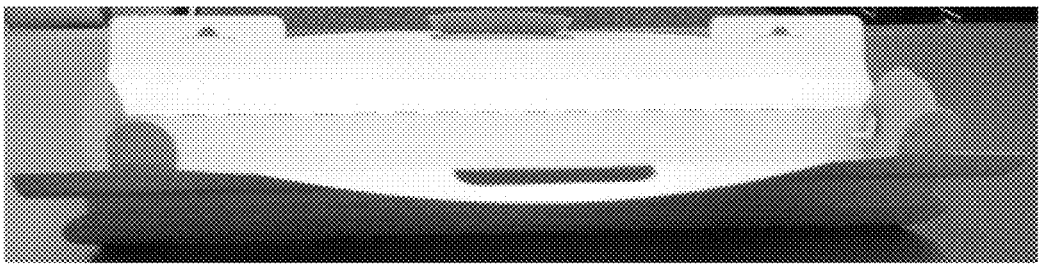
FIG. 16 illustrates a side view of the food carrier of FIGS. 6-15 in an assembled and open configuration.

FIGS. 6-11 illustrate another embodiment of a food carrier in an assembled and closed configuration. FIGS. 12-13 illustrate the food carrier of FIGS. 6-11 in an unassembled and/or flat configuration. FIGS. 14-18 illustrate the same food carrier in an assembled and open configuration.

FIG. 12 illustrates various folds and perforations and shapes used to create the food carrier 100 out of a single sheet of material. The single sheet of material 100 may be cardboard, and may be created by laser cutting, and/or die cutting, and/or manually cutting the shape shown in FIG. 12. Other cutting or formation processes may be used to create the shape shown in FIG. 12. The view of FIG. 12 shows the surface of the sheet 100 on the inside of the assembled food container, while the view of FIG. 13 shows the surface of the sheet 100 on the outside of the assembled food container.

Sheet 100 includes a bottom section 102, lower sections 104 and 108, and upper sections 106 and 110. Certain lines, which may be folds and/or perforations, extend substantially parallel to one another from end 130 to end 132 of sheet 100. Section 102 extends between lines A and B; section 104 extends between lines A and D; section 106 extends between lines D and F; section 108 extends between lines B and C; and section 110 extends between lines C and E. Section 102 remains substantially flat and forms the bottom resting surface of the assembled food carrier 100.

In assembling the food container, section 104 is folded inwardly relative to section 102 along perforation line A, and section 108 is folded inwardly relative to section 102 along perforation line B. Section 104 may itself include additional lines or folds, which may be parallel to each other and/or evenly spaced from line A to line D, with each such line permitting a slight inward fold which lends an inward curvature to section 104. In some cases, five substantially rectangular segments extend in a parallel equally spaced arrangement over section 104 between lines A and D, formed by four equally spaced parallel folds in the sheet 100. Similarly, section 108 may itself include additional lines or folds, which may be parallel to each other and/or evenly spaced from line B to line C, with each such line permitting a slight inward fold which lends an inward curvature to section 108. In some cases, five substantially rectangular segments extend in a parallel equally-spaced arrangement over section 108 between lines B and C, formed by four equally spaced parallel folds in the sheet 100.

Section 106 is then folded inwardly relative to section 104 along perforation line D, and section 110 is folded inwardly relative to section 108 along perforation line C. Section 106 may itself include additional lines or folds, which may be parallel to each other and/or evenly spaced from line D to line F, with each such line permitting a slight inward fold which lends an inward curvature to section 106. In some cases, five substantially rectangular segments extend in a parallel, equally spaced arrangement over section 106 between lines D and F, formed by four equally spaced parallel folds in the sheet 100. Similarly, section 110 may itself include additional lines or folds, which may be parallel to each other and/or evenly spaced from line C to E, with each such line permitting a slight inward fold which lends an inward curvature to section 110. In some cases, five substantially rectangular segments extend in a parallel equally-spaced arrangement over section 110 between lines C and E, formed by four equally spaced parallel folds in the sheet 100.

According to some embodiments, the additional lines or folds of each segment 104, 106, 108, 110 are not parallel to each other and/or are not equally spaced. According to some embodiments, more or less than five substantially rectangular segments are formed by each section 104, 106, 108, 110; for example, each section 104, 106, 108, 110 may include two, three, four, six, seven, eight, nine, and/or ten segments to form a cross-sectional shape of a similar number of sides.

As used herein, the term "perforation" is used in its broadest sense to refer to a structural weakness created along a segment of a surface or line, other than mere bending. A perforated line is a bent line, but a bent line is not necessarily a perforated line unless the bent line also includes a structural weakness. Examples of perforation include cutting all the way through the sheet of material 100 along a dashed or dotted line pattern, cutting partially through along a continuous or discontinuous line, and repeated bending or folding until a top or bottom surface of the material 100 is torn or ruptured along the bend line. Such cutting or perforation may be performed in a number of ways. The perforations may be created at the same time that the outer perimeter of the sheet 100 is created, and/or may be created before or after such time.

Figure 17:
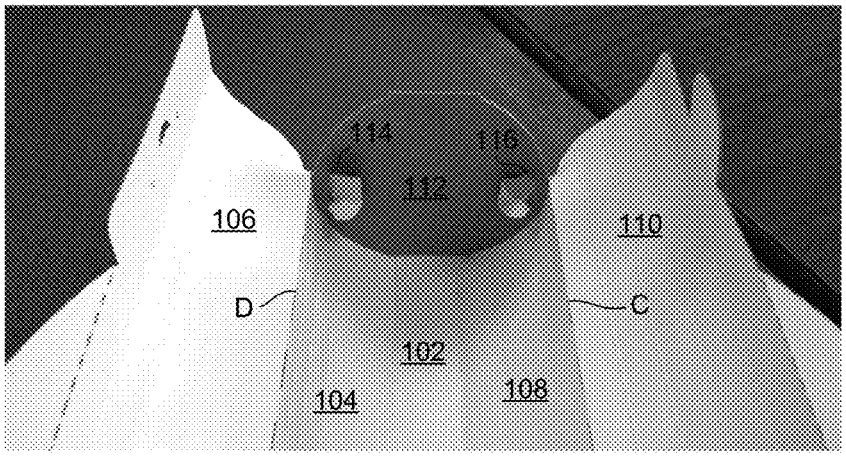
FIG. 17 illustrates an enlarged top perspective view of an inside of the food carrier of FIGS. 6-16 in an assembled and open configuration.
Figure 18:
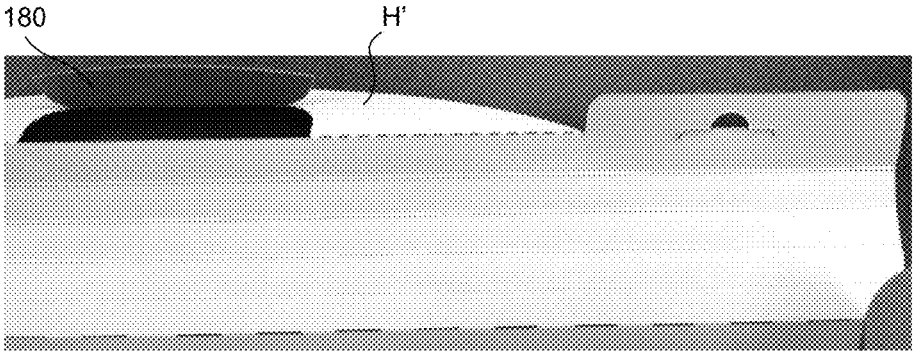
FIG. 18 illustrates an enlarged front perspective view of an inside of the food carrier of FIGS. 6-17 in an assembled and open configuration.
Figure 19:
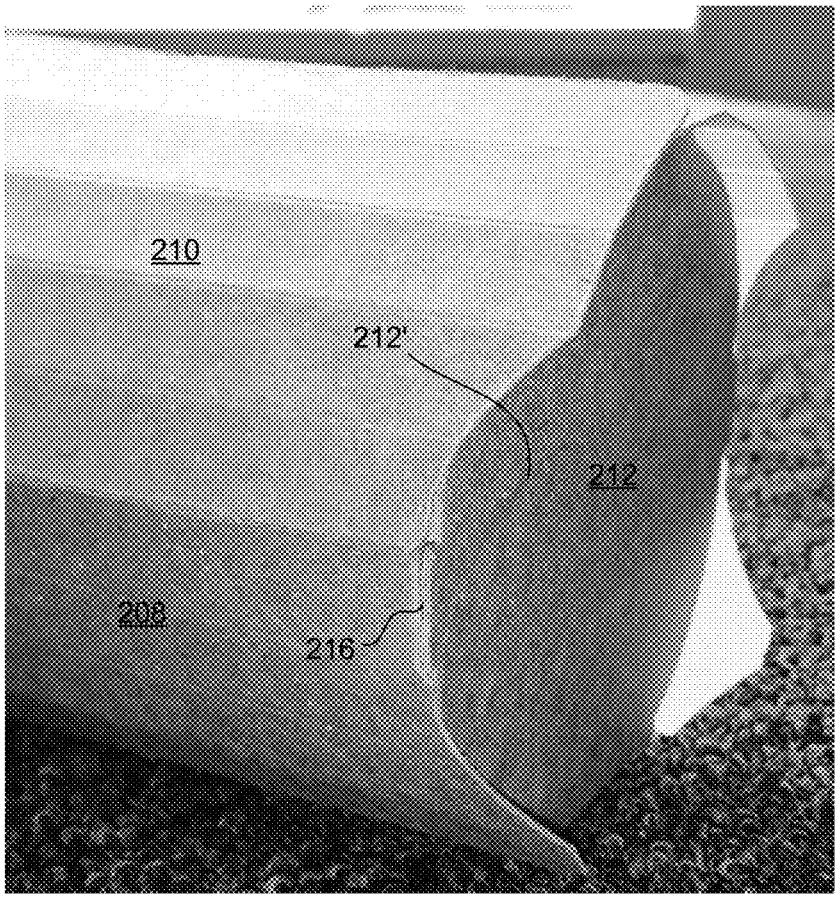
FIG. 19 illustrates a perspective end view of another embodiment of a food carrier.
Figure 20:
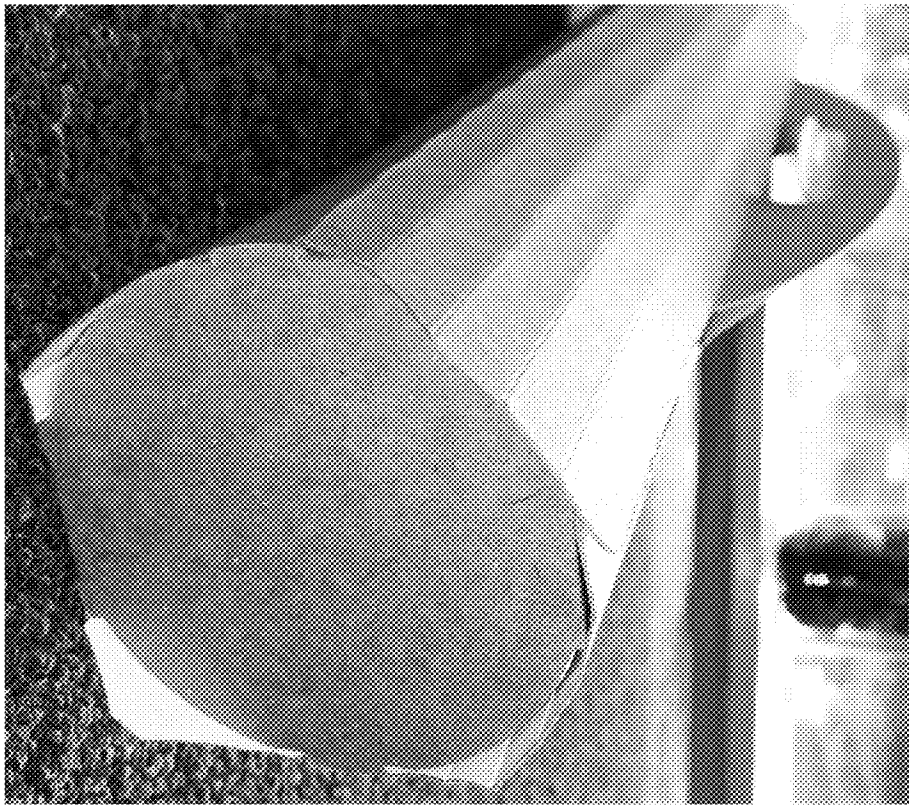
FIG. 20 illustrates another end perspective view of the food carrier of FIG. 19.
Figure 21:
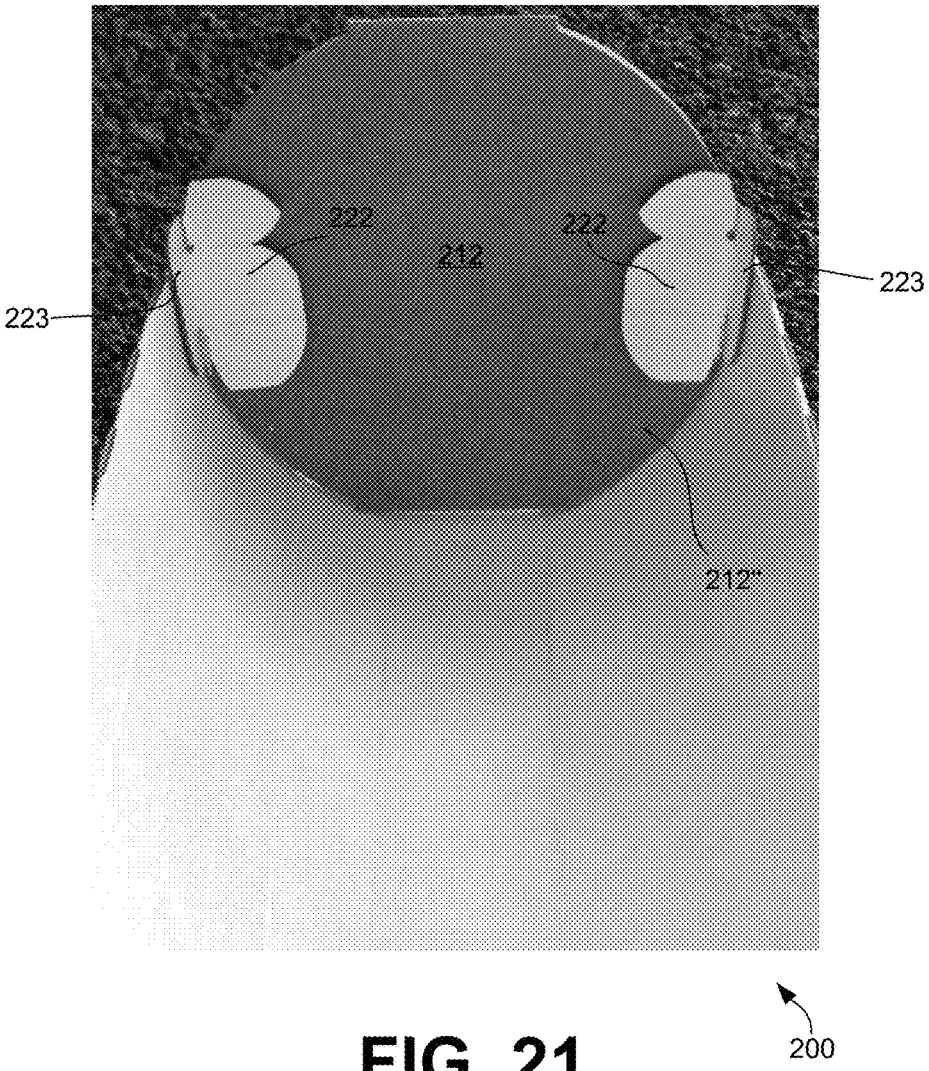
FIG. 21 illustrates an inside end view of the food carrier of FIGS. 19 and 20 in an open configuration.

Each end 130, 132 includes two tabs 122. Each tab 122 itself has two flaps that fold or may be folded toward one or both sides of the tab 122. On side 130 of the sheet is included a side flap 112' (which may also be referred to as an end cap) connected to section 102 along line or bend 124, and a side flap 112" connected to side flap 112' along line or bend 126. During assembly, side flap 112" is folded inwardly along line 126 and onto side flap 112' to form side flap 112. Doubling of the side flap 112 in this manner reinforces the side flap 212 and provides greater overall structural stability to the carrier 100. Side flap 112' includes slots 114' and 116' and side flap 112" includes slots 114" and 116"; once flap 112" is folded onto flap 112', slot 114' is aligned with slot 114" to form slot 114, and slot 116' is aligned with slot 116" to form slot 116 (see FIG. 17). During assembly, the two flaps of each tab 122 are folded onto their respective tabs 122, and one tab 122 is inserted through slot 114 from outside to inside and another tab 122 is inserted through slot 116 from outside to inside and, after insertion, the flaps of each tab 122 may be unfolded or partially unfolded to assist in the retention of the tabs 122 within their respective slots 114, 116. The same or a similar process may be used to assemble the flaps 113', 113" of the other end 132 of the sheet 100 to each other and to the tabs 122 at end 132. As shown in FIG. 17, once the tabs 122 are attached to the side flap 112, the perforated lines C and D intersect the substantially circular side flap 112 at about half the height of the substantially circular side flap 112. This adds to the aesthetics and the function of the food carrier, because the sections 106 and 110 form the flaps that removably open and close the food carrier. Thus, when the sections 106, 110 are in the open configuration, the user can see the entirety of the contents of the food carrier, and their substantial inward and upward curvature permits the sections (which may also be referred to as flaps) 106, 110 to help retain within the container any items that are stacked above the height midpoint of the side flap 112. Locating perforations C and D at the line directly at the location where the sides 108, 110 and 104, 106 are connected to the end flap 112 also promotes usability by making it easier for the box to naturally open at the perforated edges C and D rather than along some other folded edge. This also permits the side flaps 106, 110 to have less of a "flimsy" performance when opening and closing the container 100.

According to some embodiments, the slots 116', 116" are formed along a common line, for ease of manufacture.

In order to close the food carrier 100, section 106 is bent inwardly along perforated line D and section 110 is bent inwardly along perforated line C, the handle cutout H' is aligned and mated with handle cutout H" to form handle H. The handle cutout H' may further include a handle flap 180 (see FIG. 18) that may be tucked under the other handle cutout H" to better secure the handle cutouts H' and H" together. Handle flap 180 further helps to protect the user's hand from direct contact with the potentially narrower or sharp bottom edges of the handle cutouts. Also, to close the food container, the tongues 118 of section 110 may be overlapped with an inserted through the slots 120 of section 106 in order to additionally secure the food carrier 100 in a closed configuration, as shown in FIGS. 6-11. The base F of handle cutout H', and/or the base E of handle cutout H", may be perforated in order to better permit the handle H to extend substantially perpendicularly from the tubular or cylindrical cross-sectional perimeter formed by the assembled sheet 100, according to some embodiments.

The single sheet from which the cylindrical food carrier is constructed may, in various embodiments, be made of various types of paperboard. In particular embodiments, the sheet may be made of boxboard or cartonboard. In one embodiment, the sheet may be made of folding boxboard. In another embodiment, the sheet may be made of Kraft board. In another embodiment, the sheet may be made of solid bleached board or solid bleached sulphate. In another embodiment, the sheet may be made of solid unbleached board.

In an embodiment, the assembled food carrier may have a hexagonal cross section, i.e. the food carrier may have six circumferential faces. In another embodiment, the assembled food carrier may have an octagonal cross section, i.e. the food carrier may have eight circumferential faces. In still another embodiment, the assembled food carrier may have a dodecagonal cross section, i.e. the food carrier may have twelve circumferential faces. Other cross-sectional shapes and numbers of circumferential faces will be apparent to those skilled in the art. In one embodiment, the food carrier 100 includes twenty-two circumferential faces. In another embodiment, the food carrier 100 includes from twenty to twenty-four circumferential faces. In another embodiment, the food carrier 100 includes eight to twenty-four circumferential faces.

The cylindrical food carrier may be used to carry and transport a number of round food items. In one embodiment, the cylindrical food carrier may be used to carry and transport donuts. In another embodiment, the cylindrical food carrier may be used to carry and transport donut holes or donut balls. In still another embodiment, the cylindrical food carrier may be used to carry and transport fruits having a substantially round shape, such as apples, oranges, or peaches. Other uses for the cylindrical food carrier will be apparent to those skilled in the art, based on the present disclosure.

In an embodiment, the cylindrical food carrier may be constructed manually from a single flat sheet of paperboard. In another embodiment, the cylindrical food carrier may be constructed from a single sheet of paperboard having pre-fabricated creases or perforations for ease of assembly.

The cylindrical food carrier may be longer or shorter relative to the cross-sectional diameter as the user's needs dictate. In one embodiment, the cylindrical food carrier has a length-to-diameter ratio of about three to one. In another embodiment, the cylindrical food carrier has a length-to-diameter ratio of about six to one. In another embodiment, the cylindrical food carrier may have a length-to-diameter ratio of about twelve to one. In another embodiment, the cylindrical food carrier may have a length-to-diameter ratio of about eighteen to one. In another embodiment, the cylindrical food carrier may have a length-to-diameter ratio of about twenty-four to one. Cylindrical food carriers having other length-to-diameter ratios will be apparent to those skilled in the art, based on the present disclosure. In certain embodiments, the cross-sectional diameter may be sized so that the cylindrical food carrier may accommodate regular round donuts, but the food carrier may be filled to contain only donut holes, in order to, for example, create a unique and aesthetic customer experience (e.g. the experience of buying donut holes contained in a food carrier that looks like it would normally contain regular-sized donuts).

According to some embodiments, the inner surface is coated or otherwise formed of a material or coating which is safe for direct contact with food, and/or is a non-stick surface for containing potentially sticky items like glazed donut holes.

Also, while the tabs 122 are shown and described as being part of the sections 104 and 108 and the slots as part of end flaps 112 and 113, one of ordinary skill in the art, based on the present disclosure, will appreciate that the slots may instead be formed on sections 104 and/or 108, or alternatively or additionally on sections 106 and 110, and the tabs 122 may be formed on end flaps 112 and 113. Or, a combination of slots and tabs may be used, including one or more tabs 122 on sections 104, 106, 108, 110 and one or more slots on end flaps 112 and 113.

FIGS. 19-24 illustrate another embodiment of a food carrier 200, which includes some additional and different features. In some embodiments, food carrier 200 is similar to or the same as food carrier 100, and/or is constructed in a similar manner, except for the additional and/or different features or embodiments noted. The end flap 212 is constructed in a similar manner to end flap 112—flap 212" is folded onto flap 212'; however, end flap 212 includes side tabs 223 formed integrally with the flap portion 212'. These side tabs 223 include slots 216 formed therein, which are essentially aligned with the side edges of the end flap 212 where the end flap 212 interfaces with the side panels 208, 210. Lower section 208 includes tabs 222 which are formed integrally with lower section 208, and which are also at the end of the lower section 208. This arrangement permits a secure attachment while maintaining an aesthetically pleasing appearance. While tab 122 must wrap about the outer surface of end flap 112 before its insertion into the slot 116 (see FIG. 9, for example), the tab 222 can be inserted directly through slot 216 in tab 223 directly at the edge of the food carrier 200. This helps to "hide" the joint. As one of ordinary skill in the art would appreciate, based on the present disclosure, the slots 216 may alternatively be located on tabs 222 rather than tabs 223.

Figure 22:
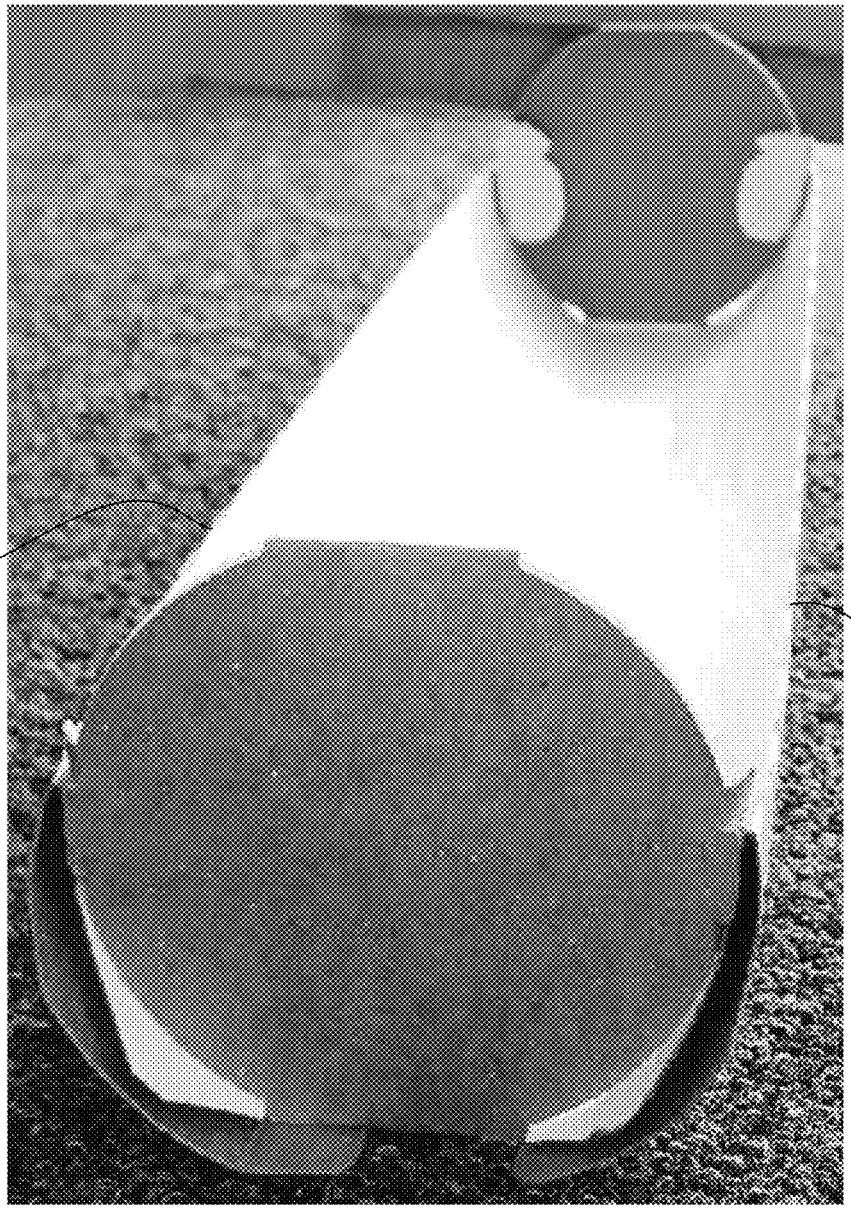
FIG. 22 illustrates a top perspective view of the food carrier of FIGS. 19-21 in the open configuration.
Figure 23:
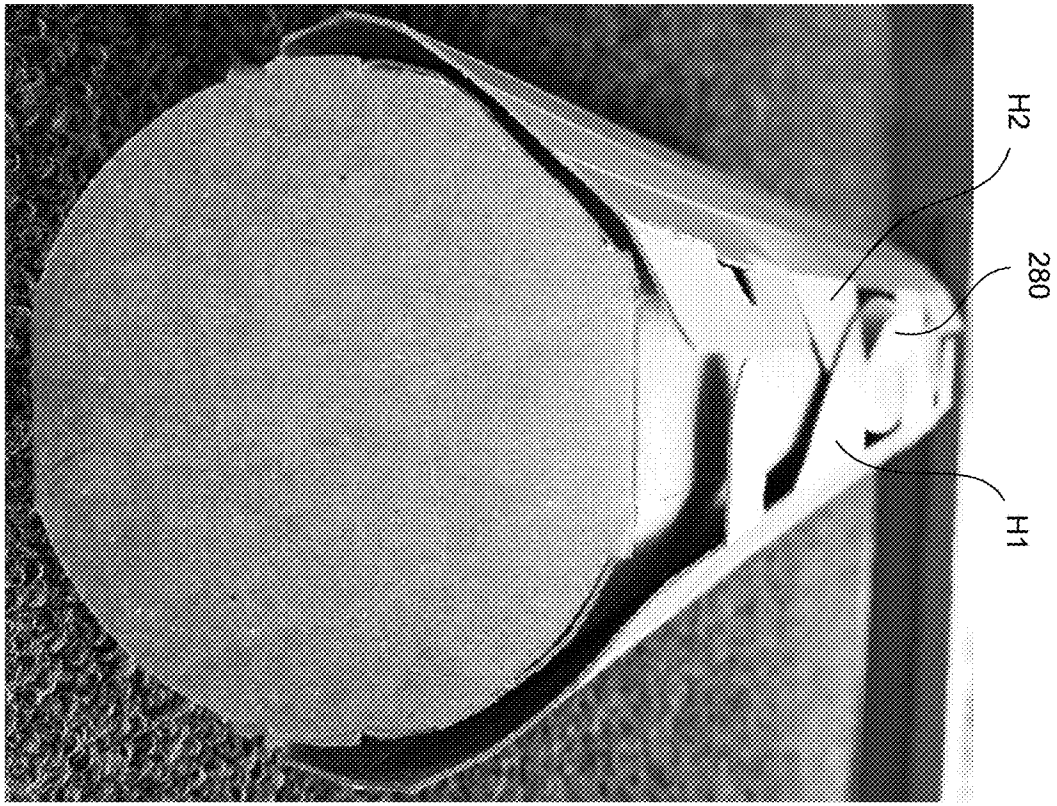
FIG. 23 illustrates a bottom perspective view of the food carrier of FIGS. 19-22 in the open configuration.
Figure 24:
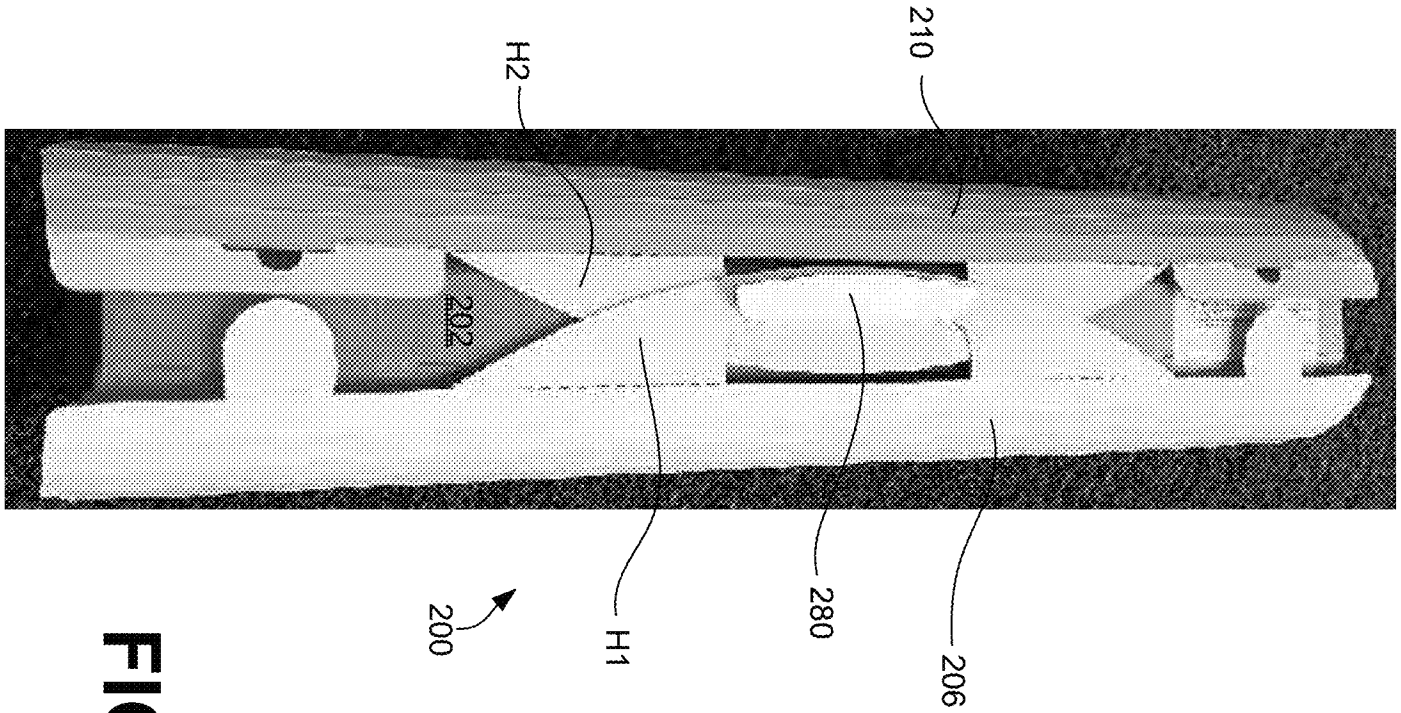
FIG. 24 illustrates a bottom plan view of the food carrier of FIGS. 19-23 in the open configuration.

The food carriers 100, 200 also permit a user to easily secure the lid flaps 206, 210 to each other underneath the bottom 202 of the carrier 200. This is illustrated in FIGS. 22-24. Each lid flap 206, 210 may be wrapped underneath the carrier 200, and the handle element H1 may be secured to handle element H2 by tucking handle flap 280 of handle element H2 under and through the handle cutout of handle element H1. The entire food carrier 200 may then be set in an upright and open position, with the lid flaps 206, 210 secured to each other and tucked under the carrier 200, in order to display the food in the carrier 200 and/or to more easily access the container 200 without lid flaps 206, 210 flapping against the sides or otherwise getting in the user's way. As such, perforations C and D not only assist the user in folding the side flaps 206, 210 to open the carrier 200, but they also assist the user in folding each flap 206, 210 onto flap 204, 208, respectively, when changing the carrier 200 to its display configuration (of FIGS. 21-24).

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations, together with all equivalents thereof.

What is claimed is:

1. A carrier, comprising:

a single sheet of material comprising:

a base section;

a first end flap connected to the base section at a first longitudinal end of the base section, the first end flap including a first slot and a second slot;

a second end flap connected to the base section at a second longitudinal end of the base section, the second end flap including a third slot and a fourth slot;

a first lower section connected to the base section along a first line, the first lower section including a first tab at the first longitudinal end and a second tab at the second longitudinal end;

a second lower section connected to the base section along a second line, the second lower section including a third tab at the first longitudinal end and a fourth tab at the second longitudinal end;

a first upper section connected to the first lower section along a third line, the first upper section comprising a first handle element; and a second upper section connected to the second lower section along a fourth line, the second upper section comprising a second handle element;

wherein the single sheet of material is configured for arrangement in a flat configuration and an assembled configuration, wherein in the flat configuration the single sheet of material is a substantially flat layer, wherein in the assembled configuration the first and second end flaps are substantially perpendicular to the base section, the first tab engages the first slot, the second tab engages the third slot, the third tab engages the second slot, and the fourth tab engages the fourth slot, and the base section, first and second lower sections, and first and second upper sections together form a substantially tubular cross-sectional shape, and wherein the first and second handle elements are configured to form a handle when the carrier is in the assembled configuration, the handle extending from the substantially tubular cross-sectional shape, and wherein the first and second handle elements are further configured to couple together adjacent to an exterior of the base section when the carrier is in the assembled configuration such that an interior of the carrier is visible.

2. The carrier of claim 1, wherein two or more of the first, second, third, and fourth lines are perforated.

3. The carrier of claim 1, wherein the first, second, third, and fourth lines are perforated.

4. The carrier of claim 1, further comprising two or more longitudinal folds formed substantially parallel to, and between, one or more of the following pairs of lines: the first and third lines, and the second and fourth lines.

5. The carrier of claim 1, further comprising five or more longitudinal folds formed substantially parallel to, and between, the first and third lines, and the second and fourth lines.

6. The carrier of claim 4, wherein the two or more longitudinal folds are equally circumferentially spaced with respect to each other.

7. The carrier of claim 1, wherein the handle comprises an opening, the opening configured to allow a human hand to grasp the handle.

8. The carrier of claim 7, wherein the first handle element comprises a first cutout and the second handle element comprises a second cutout, the first and second cutouts configured to at least partially align to form the opening of the handle.

9. A method of assembling a single-sheet cylindrical food carrier, the method comprising:

folding a first end flap inwardly with respect to a first longitudinal end of a base section, the first end flap including a first slot and a second slot;

folding a second flap inwardly with respect to a second longitudinal end of the base section, the second end flap including a third slot and a fourth slot;

folding a first lower section inwardly along a first line shared with the base section, the first lower section including a first tab at a first longitudinal end of the first lower section and a second tab at the second longitudinal end of the first lower section;

folding a second lower section inwardly along a second line shared with the base section, the second lower section including a third tab at a first longitudinal end of the second lower section and a fourth tab at a second longitudinal end of the second lower section;

folding a first upper section inwardly along a third line shared with the first lower section, the first upper section including a first handle element, the first handle element having a first cutout;

folding a second upper section inwardly along a fourth line shared with the second lower section, the second upper section including a second handle element, the second handle element having a second cutout; and coupling the first tab with the first slot, the second tab with the third slot, the third tab with the second slot, and the fourth tab with the fourth slot to form a substantially tubular cross-sectional shape, and further comprising coupling the first and second handle elements to form an open configuration, wherein the first and second upper sections are folded to be adjacent to at least the first and second lower sections in the open configuration.

10. The method of claim 9, further comprising coupling the first and second handle elements to form a closed configuration, wherein the first and second upper sections come together to enclose an interior of the single-sheet cylindrical food carrier in the closed configuration.

11. The method of claim 9, further comprising coupling the first and second handle elements to form a closed configuration, wherein the first and second upper sections come together to enclose an interior of the single-sheet cylindrical food carrier in the closed configuration.

12. A carrier, comprising:

a single sheet of material comprising:

a base section;

a first end flap connected to the base section at a first longitudinal end of the base section, the first end flap including a first slot and a second slot;

a second end flap connected to the base section at a second longitudinal end of the base section, the second end flap including a third slot and a fourth slot;

a first lower section connected to the base section along a first line, the first lower section including a first tab at the first longitudinal end and a second tab at the second longitudinal end;

a second lower section connected to the base section along a second line, the second lower section including a third tab at the first longitudinal end and a fourth tab at the second longitudinal end;

a first upper section connected to the first lower section along a third line; and a second upper section connected to the second lower section along a fourth line;

wherein the single sheet of material is configured for arrangement in a flat configuration and an assembled configuration, wherein in the flat configuration the single sheet of material is a substantially flat layer, wherein in the assembled configuration the first and second end flaps are substantially perpendicular to the base section, the first tab engages the first slot, the second tab engages the third slot, the third tab engages the second slot, and the fourth tab engages the fourth slot, wherein the first and second upper sections are configured to be coupled together, wherein in the assembled configuration when the first and second upper sections are coupled together substantially opposite from the base section, the carrier forms a substantially tubular cross-sectional shape in a closed configuration; and wherein in the assembled configuration when the first and second upper sections are pivoted outward toward the base section, a display configuration is formed such that an interior of the carrier is exposed, and wherein the first and second upper sections are pivoted to be adjacent to at least the first and second lower sections in the display configuration, the first upper and second upper sections configured to couple about the base section.

13. The carrier of claim 12, wherein the first and second upper sections are pivoted to be adjacent to at least the first and second lower sections in the display configuration, the first and second upper sections configured to couple together substantially along and external to the base section.

14. The carrier of claim 12, further comprising:

a first handle element extending from the first upper section, the first handle element having a first cutout; and a second handle element extending from the second upper section, the second handle element having a second cutout;

wherein the first and second handle elements come together to form a handle when the carrier is in the closed configuration, the handle extending from the substantially tubular cross-sectional shape.

* * * * *